US008082781B1

(12) United States Patent
Abshire

(10) Patent No.: US 8,082,781 B1
(45) Date of Patent: Dec. 27, 2011

(54) APPARATUS FOR PRESSURE TESTING A PRESSURE FOOT

(76) Inventor: Phillip E. Abshire, Lafayette, LA (US)

( * ) Notice: Subject to any disclaimer, the term of this patent is extended or adjusted under 35 U.S.C. 154(b) by 0 days.

(21) Appl. No.: 13/104,747

(22) Filed: May 10, 2011

Related U.S. Application Data

(62) Division of application No. 11/903,785, filed on Sep. 24, 2007, now Pat. No. 7,716,979.

(51) Int. Cl.
*E21B 47/00* (2006.01)

(52) U.S. Cl. ..... 73/152.54; 166/250.01

(58) Field of Classification Search ..... 73/152.51, 73/152.52, 152.54, 152.55; 166/250.01, 166/250.17
See application file for complete search history.

(56) References Cited

U.S. PATENT DOCUMENTS 3,958,633 A * 5/1976 Britch et al. ..... 166/117.5
4,281,723 A * 8/1981 Edmond et al. ..... 175/76
4,498,536 A 2/1985 Ross et al.
4,711,305 A 12/1987 Ringgenberg
5,168,933 A * 12/1992 Pritchard et al. ..... 166/348
5,875,852 A * 3/1999 Floyd et al. ..... 166/387
5,934,371 A 8/1999 Bussear et al.
6,253,856 B1 * 7/2001 Ingram et al. ..... 166/374
6,269,683 B1 8/2001 Jackson
7,716,979 B1 * 5/2010 Abshire ..... 73/152.54
7,987,708 B1 * 8/2011 Abshire ..... 73/152.54
2008/0066906 A1 * 3/2008 Huff et al. ..... 166/250.17

* cited by examiner

*Primary Examiner* — John Fitzgerald

(57) ABSTRACT

An apparatus for the testing of downhole an injection assembly prior to installation of the injection assembly in the completion string is disclosed. The apparatus is comprised an injection tubing, an injection sub, an injection valve, an injection sub test block, a pressure foot, a pressure foot test block, and means for introducing pressure at a desired level. The injection sub test block, pressure foot, pressure foot test block are interchangeably engageable with the injection sub for testing in a sequence to allow the pre-testing of the connections of components of the injection assembly at the surface of the well.

2 Claims, 8 Drawing Sheets

APPARATUS FOR PRESSURE TESTING A PRESSURE FOOT

This application is a divisional of prior application Ser. No. 11/903,785 filed Sep. 24, 2007 now U.S. Pat. No. 7,716,979. This is a divisional application under 37 CFR 1.53(b) entitled "An Apparatus for Pressure Testing a Pressure Foot" The pending prior application is Ser. No. 12/749,173 filed Mar. 29, 2010 by Applicant for "Apparatus for the Testing of Downhole Injection Assemblies," the entire contents of which are hereby incorporated by reference. This application claims priority to prior application Ser. No. 11/903,785 now U.S. Pat. No. 7,716,979 B1.

FIELD OF INVENTION

This invention generally relates to the field of chemical injection in oil and gas wells. More particularly, it provides an improved method and apparatus for the testing of downhole injection assemblies prior to installation of the injection assembly in the completion string.

BACKGROUND OF INVENTION

It is often necessary to inject chemicals into the completion string or tubing of a completed well. For example, it may be useful to inject chemicals into the completion tubing to combat well conditions such as corrosion, paraffin, scale, or hydrate build up in the completion tubing. Flow properties of well can be enhanced through the injection of foaming agents or gas. The injection of chemical is typically accomplished by means of an injection assembly comprised of a sub or mandrel having injection tubing and an injection valve that is pre-installed on the completion string. The desired chemical is then pumped into the completion string by means of a pump at the surface of the well through the injection assembly by means of the injection tubing and the injection valve.

Before chemical can be injected into the completion string it is necessary to test the connections of the injection assembly including the connections between the injection sub, injection tubing, the injection valve, and the completion string in order to insure their integrity. This is typically done after the injection assembly is made up in the completion string that is to be inserted into the well bore. Pressure testing is typically done by running a test tool, on wire line with pressure hose, into the internal diameter of the completion tubing or string. This test tool is an elongated shaft having a pack off device positioned at each end. The pack off device is intended to seal a segment of the completion string or injection sub with the injection port of the injection sub between each pack off device. Before testing is accomplished the pack off device at each end of the test tool must be packed off and sealed against the internal diameter of the completion tubing or string.

Once the test tool is packed off and sealed, pressure is applied through the test tool in the space between each pack off device to test the injection sub, the pressure check in the injection valve, and the connection between the injection sub and the injection valve. Testing is accomplished by placing the ends of the test tool across the injection port of the injection sub that has been attached to completion and pressured up to the desired test pressure. While pressure is maintained, the injection tubing can be pressured up, to test the control line, the injection valve, any pressure check valves, and the connection between the upper injection valve and the injection tubing. Pressure can also be applied through the injection sub and injection tubing to verify that the injection valve will open at a desired pressure for the injection of chemicals into the production string.

It should be noted that injection tubing is eliminated when annular injection systems are utilized but the use of the internal completion tubing pressure testing device as described is still typically used in completion strings having annular injection systems)

Often times it is desirable to include a pressure burst disk in the injection assembly to allow access to the completion string in the well bore at a future time. This access can be accomplished by increasing the pressure in the injection assembly to an amount sufficient to burst the disk and gain access to the completion string. If such a pre-set pressure burst disk is required in the injection assembly, the typical test procedure has to be modified to avoid damage to the pressure burst disk. Due to the design of the pressure burst disk, the manufacturers do not recommend to pressure up on the backside or low-pressure side of a disk. Doing so could cause deformation of the disk that may change its pre-set burst pressure. Consequently, when pressure burst disks are utilized in the injection assembly all components of the injection assembly cannot be tested by the typical methods.

To test the injection tubing or valve connection, a testable fitting or connector is sometimes utilized. Such a testable fitting or connector generally will incorporate two sealing ferrules. Pressure can be applied through an external port to test the area between the two sealing ferrules. This tests only the external area between the sealing ferrules. It does not test the injection sub, injection valve, injection tubing, or any internal flow paths.

The internal wire line test tool described above presents many risks and disadvantages. The internal wire line test tool can become stuck in the completion string, be blown out of completion string, or break the wire line can break allowing the pressure test tool to fall downhole. Another and perhaps more significant disadvantage is that the injection sub may be damaged by the pressure test causing it to come apart, possibly resulting in the production string falling downhole. Further, pressure testing on rig floor increases rig time resulting in higher costs. Elevated pressures at the surface from the testing equipment can expose service personnel to unwarranted dangers creating personnel safety concerns. Consequently, there is a need for an improved method and apparatus to test the injection sub, with injection valve pre-installed, prior to the time the sub assembly is made up in the completion string and inserted into the well bore in order to reduce the incidence of the aforementioned risks and disadvantages.

SUMMARY OF INVENTION

The present invention provides an improved method and apparatus to test the injection sub, with injection valve pre-installed, prior to the time the sub assembly is made up in the completion string and inserted into the well. It is contemplated that the method and apparatus described herein will reduce the risks and disadvantages associated with conventional testing apparatus and methods.

Applicant's injection sub assembly and method utilizes an injection sub or mandrel having a communication port or bore through the outside wall of the sub substantially perpendicular to the longitudinal axis of the sub or mandrel. The communication port area on the injection sub will have a machined surface area, for multiple seals, to attach a ported mating pressure foot. The surfaces between the injection sub and mating pressure foot may have surfaces, recesses or grooves for the use of corresponding o-rings, metal crush rings, tapered inserts, or a combination of any, for the purpose of isolating a testable void between these seals.

The ported mating pressure foot may have an intersecting port or valve coupling, perpendicular to the mating surface port, to attach an injection valve. This will allow flow through the injection sub, align the injection valve parallel to the injection sub to facilitate connection of the injection valve to injection tubing as well as facilitate insertion of the injection assembly into the well bore.

The injection sub of Applicant's apparatus and method may be provided with a removable solid shipping/test block mounted over the injection port. This test block will allow for testing of the injection sub prior to its installation in the production string. Use of the test block will allow the injection sub to be tested on the rig deck or prior to its shipment to the rig. This will allow a pre-tested injection sub to be installed in the completion string, eliminating the need to utilize the test tool assembly with two pack offs to test the injection/valve connection.

The injection assembly may include an injection valve having upper and lower valve connections. During assembly the lower valve connection of the injection valve is connected to the mating pressure foot and the injection tubing is connected to the upper valve connection of the injection valve.

A ported test block is provided for attachment to the mating pressure foot. Test pressure as desired can then be applied through the test block, through the mating pressure foot, and against the pressure check in the injection valve. While pressure is maintained, the injection tubing can be pressured up, to test the control line, injection valve above the pressure check in the injection valve, and the connection between the upper valve and injection tubing. Pressure can be released from the mating pressure foot test block and injection tubing pressure will be released through the injection valve verifying that the valve will open.

The test block on the injection sub and the ported test block on the mating pressure foot can then be removed. The mating pressure foot can then be mounted to the injection sub. A final test of the injection assembly will be applying pressure in a test port located on the outside of the mating pressure foot. This pressure will be applied between the multiple seal area to verify that the injection sub and mating pressure foot is a closed system.

An embodiment of Applicant's method and apparatus allows the injection sub to be tested prior to its shipment to the rig or on the rig deck. This eliminates the risks associated with the testing of an injection sub installed in the production string. An embodiment of Applicant's method and apparatus allows the injection valve, injection tubing, and the associated connections to be tested prior to their installation on the injection sub. The only testing required on the rig floor is the assembly of the injection sub and the mating pressure foot. This will eliminate rig time and reduce service personnel exposure to pressure testing. No tools are required to enter the internal diameter of the completion string for testing. All connections are pressure tested internally. Standard fittings/connectors can be used and external ported testable fitting/connectors are not required.

Consequently, it is an object of an embodiment of this invention to provide a method and apparatus for testing an injection sub assembly that eliminates the need for pressure testing an injection sub assembly while it is connected to a completion string in a well bore.

It is another object of an embodiment of this invention to provide a method and apparatus for pressure testing an injection sub assembly that will reduce rig time and the exposure of service personnel to pressure testing.

It is another object of an embodiment of this invention to provide a method and apparatus the will allow the injection valve, injection tubing, and the associated connections of an injection assembly to be tested prior to their installation on the injection sub.

It is another object of an embodiment of the invention to allow a burst disk to be applied between the injection sub port and mating pressure foot after the injection sub and mating pressure foot have been tested. The method and apparatus of Applicant's invention will allow the final testing of the connection between the injection sub and mating pressure foot without affect the integrity of the burst disk.

DESCRIPTION OF PREFERRED EMBODIMENT

Figure 1:
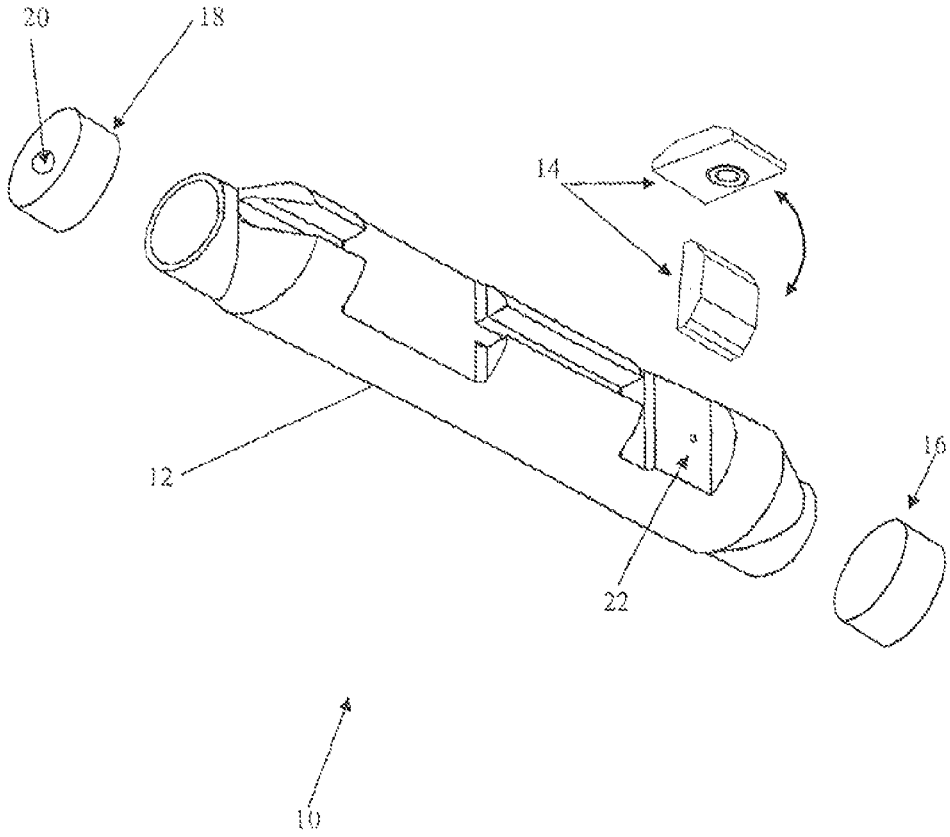
FIG. 1 is an exploded schematic representation of the injection assembly of an embodiment of Applicant's invention depicting an injection sub with test block installed.

Referring now to the drawings, there is shown a representation of the injection assembly (10) along with the method and apparatus for the testing of such an injection assembly prior to installation of the injection assembly in a completion string. Referring more particularly to FIG. 1, there is shown an exploded schematic representation of the injection assembly (10) having an injection sub or mandrel (12). The features of the method and apparatus of Applicant's invention as depicted present the injection sub or mandrel (12), a test block (14), a blank pressure cap (16), and a ported pressure cap (18) having a port (20). The injection sub (12) is provided with a communication port (22) that will allow injection of gases or fluids into a completion string when the injection sub (12) is attached to a completion string of an oil and gas well.

Testing can be performed internally on the sub (12) by installing a pressure test block (14) over the communication port (22) of the injection sub (12) so as to close the communication port (22), plugging off one end of the sub (12) with a blank pressure cap (16), and installing a ported pressure cap (18) on the opposite end of the sub (12). Internal pressure can be introduced into the sub (12) through the ported pressure cap (18) by means of a pressure line, valve, pump and pressure gauging means which is not shown. This internal pressure testing of the sub (12) can be accomplished prior to its shipment to the well and/or on the deck of the rig prior to its installation on the completion string. Test block (14) can remain on the injection sub for shipping and handling protection of the sub (12).

Figure 2:
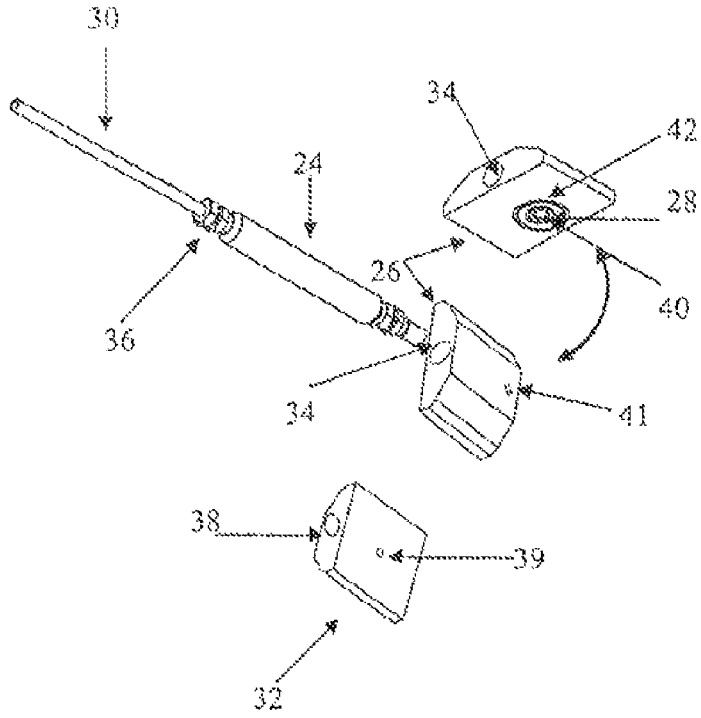
FIG. 2 is an exploded schematic representation of the injection assembly of an embodiment of Applicant's invention depicting injection tubing, injection valve and pressure foot with test block installed.

FIG. 2 is an exploded schematic representation testing configuration employing an embodiment of applicant's method and apparatus. There is shown an injection valve (24), a pressure foot (26) having a fluid passage test port (28), a control line (30), and a pressure foot test block (32). The injection valve (24) is attached to the pressure foot (26) by means of a valve coupling (34) at the upper or up-hole end of the pressure foot (26). The injection valve (24) is also attached to a control line (30) by a second valve coupling (36) at the upper or up-hole end of the injection valve (24). A pressure foot test block (32) having a test block valve coupling (38) is mounted under the pressure foot (26) for communication between the fluid passage test port (28) of the pressure foot (26), and the test block communication port (39) of the pressure foot test block (32).

Pressure can then be introduced into the injection valve (24), by means of a pressure line, valve, pump and pressure gauging means which is not shown, through pressure foot (26) by means of the test block valve coupling (38) of the pressure foot test block (32) by means of the fluid passage test port (28) of the pressure foot (26). This pressure will test the connection between the injection valve (24) and the pressure foot (26). It will also provide a test of the internal back pressure check of the injection valve (24).

While pressure is held on the injection valve (24) and the pressure foot (26) assembly, internal pressure can be applied through the control line (30) to test the connection at the second valve coupling (36) between the control line (30) and the upper or up-hole end of the injection valve (24). Upon completion of the test, pressure can be bled off through the test block valve coupling (38) of the pressure foot test block (32). This will allow pressure in the control line (30) to release through the valve (24) and test a preset injection check to be maintained for the injection valve (24).

Figure 3:
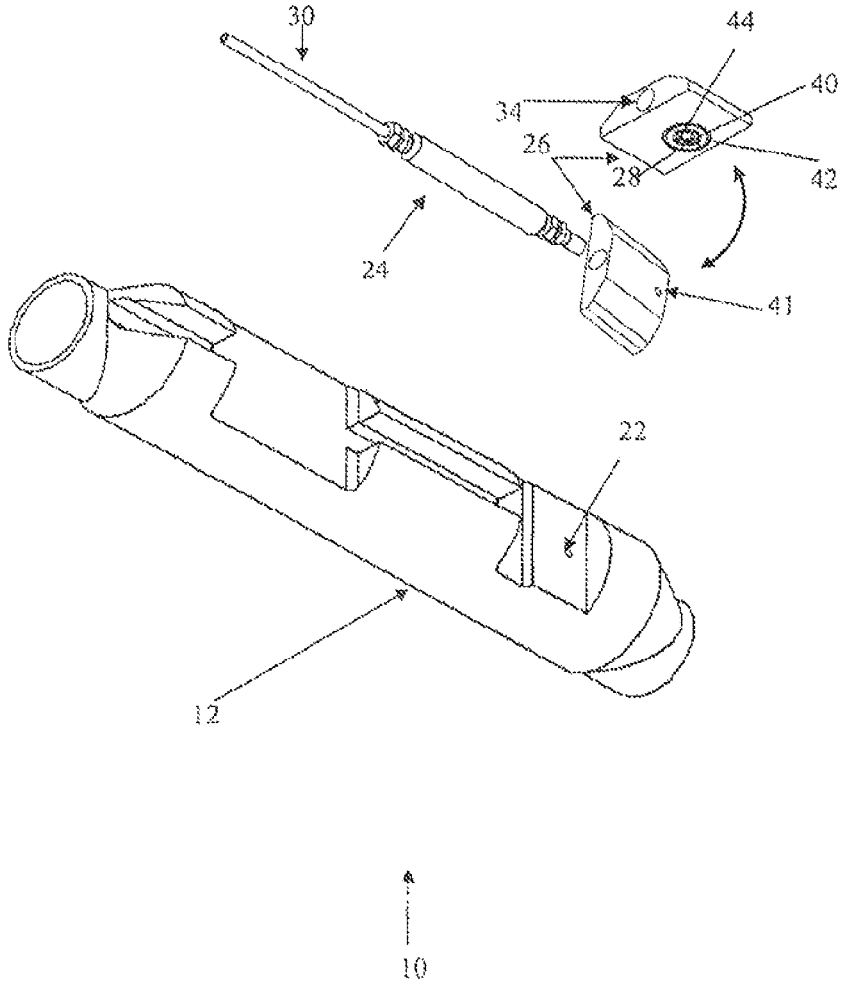
FIG. 3 is an exploded schematic representation of the injection assembly of an embodiment of Applicant's invention depicting an injection sub and valve assembly assembled for a final test.

FIG. 3 depicts a method and apparatus for a final test of the injection assembly (10) and its injection sub (12), injection valve (24), and pressure foot (26). The test is accomplished by removing the injection sub test block (14) from the injection sub (12), removing the pressure foot test block (32) from the pressure foot (26), and mounting the pressure foot (26) with injection valve (24) and control line (30) assembly to the injection sub (12).

The surface area surrounding the communication port (22) of the injection sub (12) is a machined surface area for sealable engagement of the communication port (22) with the fluid passage test port (28) of the pressure foot (26). The surfaces surrounding the communication port (22) of the injection sub (12) and the fluid passage test port (28) of the pressure foot (26) are machined or otherwise configured to provide a pressure seal by means of surfaces, recesses or grooves for the use of corresponding o-rings, metal crush rings, tapered inserts, or a combination of any, for the purpose of isolating a testable void between these seals. It is thought that a double seal configuration of first seal (40) and second seal (42) will be provided at the pressure seal connection of the communication port (22) of the injection sub (12) and the fluid passage test port (28) of the pressure foot (26).

Pressure, by means of a pressure line, valve, pump and pressure gauging means which is not shown, can be applied through the pressure foot test port (41) of the pressure foot (26) to test the void area (44) between the double seals (40) and (42) to verify the integrity of the connection between fluid passage test port (28) of the pressure foot (26) and the communication port (22) of the injection sub (12).

Figure 4:
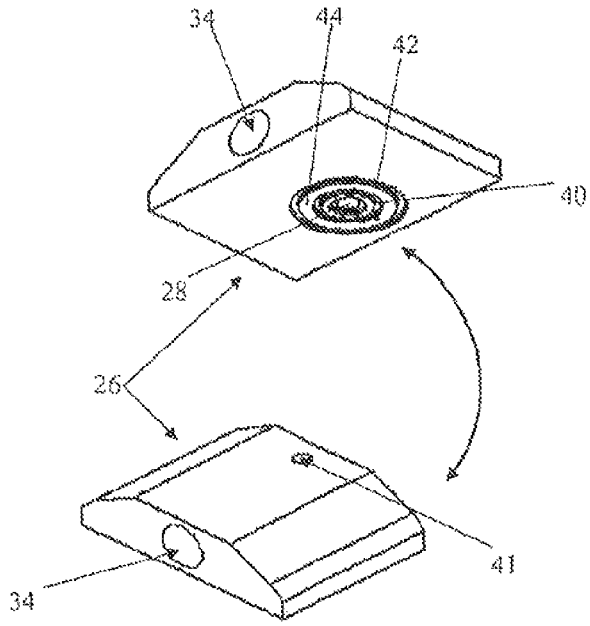
FIG. 4 is an enlarged schematic representation of the injection assembly of an embodiment of Applicant's invention depicting a pressure foot assembly with two groove rings.
Figure 5:
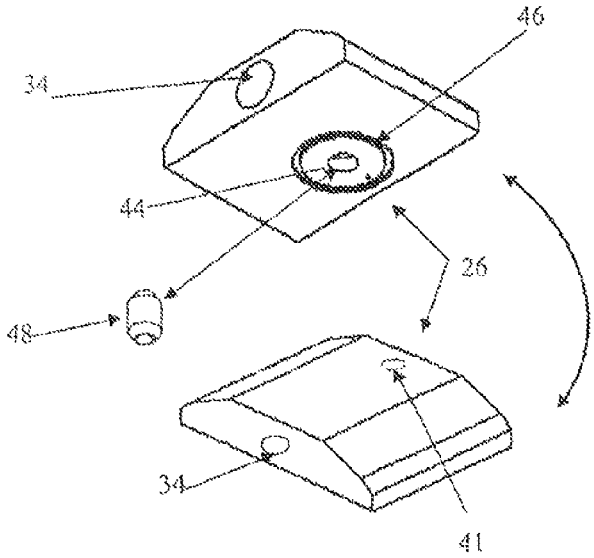
FIG. 5 is an enlarged schematic representation of the injection assembly of an embodiment of Applicant's invention depicting a pressure foot assembly with one ring groove and a sealing nipple.

FIG. 4 is an enlarged view of the pressure foot (26) with the double seals (40) and (42) to isolate a void area (44) as described above. FIG. 5 is an enlarged view of the pressure foot (26) showing an alternate double seal configuration, in this case a single ring groove seal (46) and a tapered insert (48) for the fluid passage test port (28) in order to create a void area (44) for testing purposes.

Figure 6:
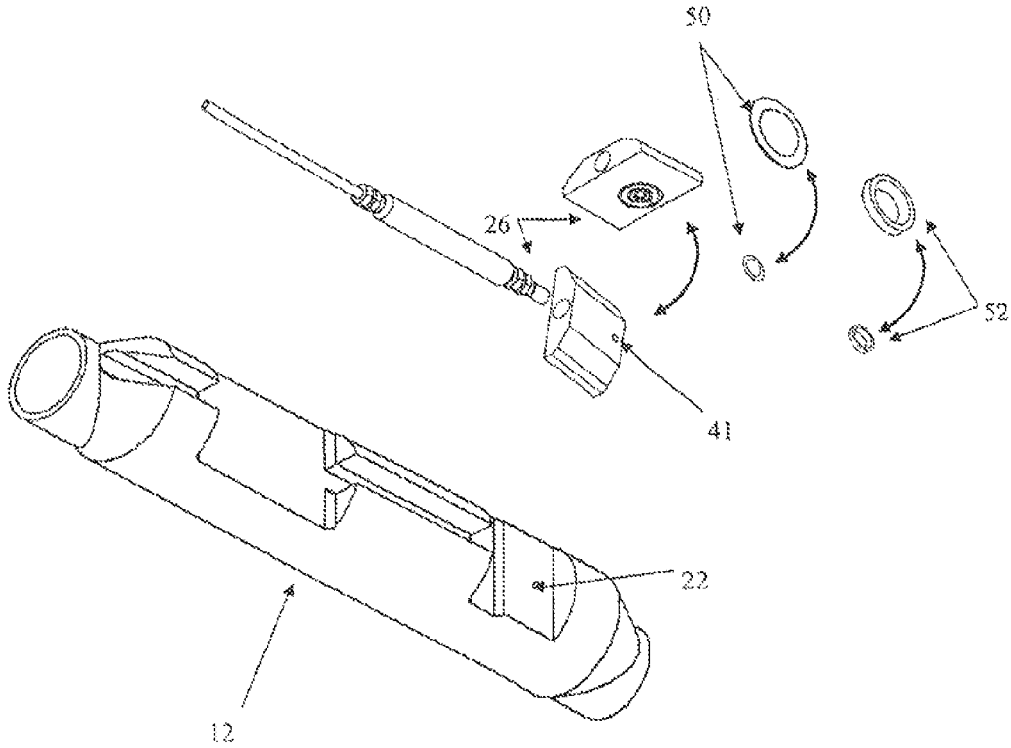
FIG. 6 is an exploded schematic representation of the injection assembly of an embodiment of Applicant's invention depicting a burst disk and burst disk retainer installed into a recessed area in mating pressure foot before the final test on the mating pressure foot.

FIG. 6 is an exploded schematic representation of the injection assembly of an embodiment of Applicant's method and apparatus depicting a burst disk (50) and burst disk retainer (52) installed into a recessed area in mating pressure foot (26). Alternatively, the recessed area for the burst disk may also be located in the injection sub (12). Installation of the burst disk is done before the final test on the mating pressure foot (26). In this manner, the burst disk (50) and retainer (52) can be applied between the communication port (22) and mating fluid passage test port (28) of the pressure foot (26) after the injection sub (12) and mating pressure foot (26) have been tested. The testing of the void area (44) around the fluid passage test port (28) is to verify the connection between the injection sub (12) and mating pressure foot (26). This will not affect the integrity of the burst disk (50).

Figure 7:
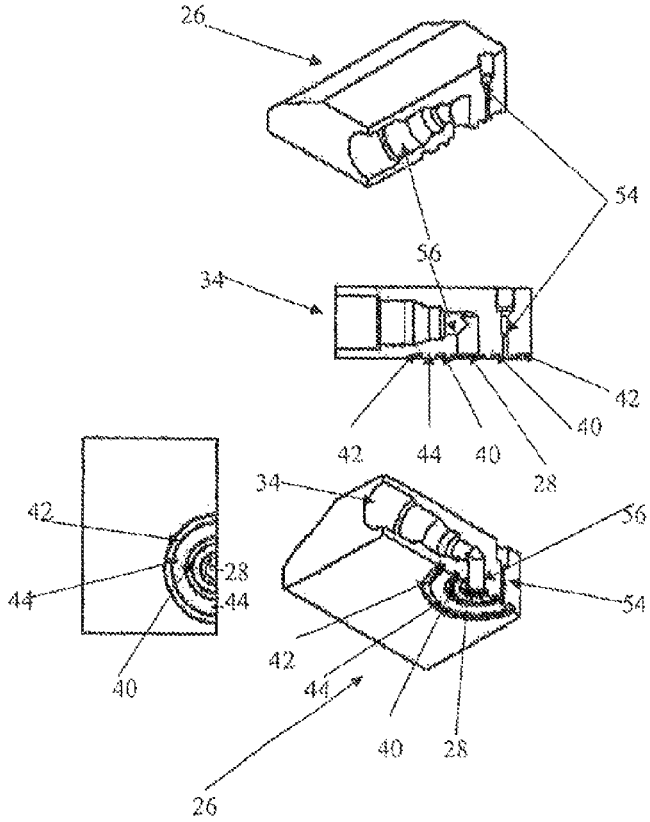
FIG. 7 is schematic representation of the pressure foot in cutaway.

FIG. 7 is a schematic representation of the pressure foot in cutaway. First seal (40) and second seal (42) create a void (44). Pressure may be introduced through the pressure foot test port (41) and through a second channel (54) of the pressure foot (26). A valve coupling (34) is connected to the fluid passage test port (28) by a first channel (56).

Figure 8:
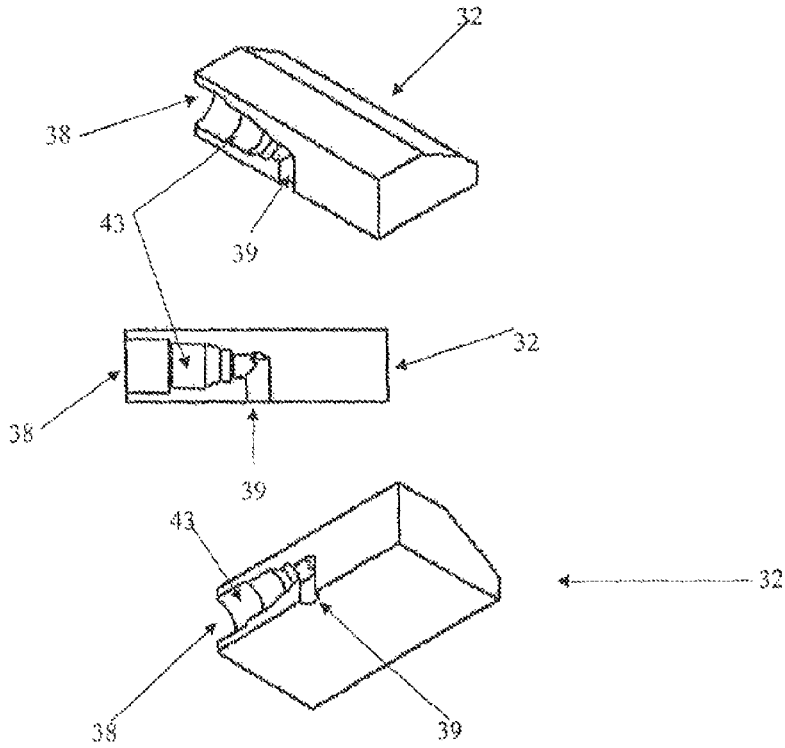
FIG. 8 is a schematic representation of the pressure foot test block in cutaway.

FIG. 8 is a schematic representation of the pressure foot test block in cutaway. The pressure foot test block (32) has a test block valve coupling (38) and a test block communication port (39) connected by a channel (43).

Figure 9:
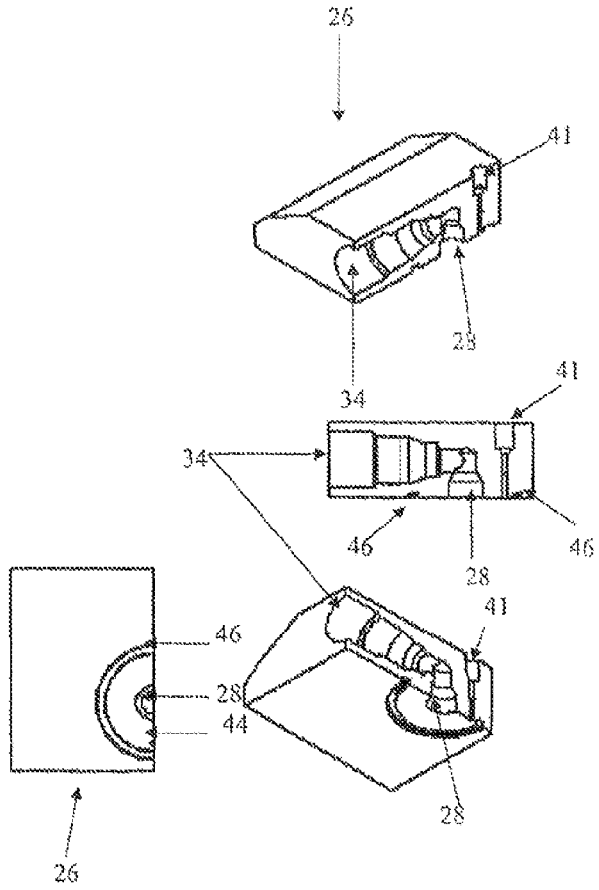
FIG. 9 is a schematic representation of the pressure foot test block in cutaway showing an alternate double seal configuration.

FIG. 9 is a schematic representation of the pressure foot test block in cutaway showing an alternate double seal configuration. Fluid passage test port (28) is adapted for receiving a tapered insert (48) as shown in FIG. 5.

It is thought that the method and apparatus for the testing of a downhole injection assembly described herein and many of its intended advantages will be understood from the foregoing description. It is also thought that various changes in form, construction, and arrangement of the parts of the method and apparatus may be made without departing from the spirit and scope of the invention described herein. The form herein described is intended to be merely an illustrative embodiment of the invention.

I claim:

1. An apparatus for pressure testing a pressure foot comprising:

a. a test block;

b. a test block valve coupling on said test block;

c. a test block communication port on said test block; and d. a channel between said test block valve coupling and said test block communication port.

2. An apparatus for pressure testing a pressure foot comprising:

a. a pressure test block, said test block having a test block valve coupling on said test block, said test block valve coupling configured for engaging a valve coupling on a pressure foot, a test block communication port on said test block, and a channel between said test block valve coupling and said test block communication port, and b. a means for introducing and releasing pressure into said pressure test block by means of said test block valve coupling whereby pressure is introduced and released in said pressure foot.

* * * * *